United States Patent [19]

Chen

[11] Patent Number: 4,561,571

[45] Date of Patent: Dec. 31, 1985

[54] WASHING LIQUID SUPPLIER

[76] Inventor: Jason K. S. Chen, 306, E. 30th, #2, Austin, Tex. 78705

[21] Appl. No.: 527,431

[22] Filed: Aug. 29, 1983

[51] Int. Cl.[4] ..... B65D 37/00

[52] U.S. Cl. ..... 222/207; 222/181; 222/383

[58] Field of Search ..... 222/173, 180, 181, 185, 222/206, 207, 212, 213, 215, 380, 383, 476, 490, 491, 494, 495, 496, 511, 544, 545; 417/566

[56] References Cited

U.S. PATENT DOCUMENTS

| | | | |
|---|---|---|---|
| 1,392,601 | 10/1921 | Rose | 222/207 |
| 2,814,419 | 11/1957 | Lipman | 222/207 |
| 3,130,877 | 4/1964 | Miller | 222/207 |
| 3,952,918 | 4/1976 | Poitras et al. | 222/82 |
| 4,146,156 | 3/1979 | Cassia | 222/181 |
| 4,330,071 | 5/1982 | Ohlson | 222/207 |

FOREIGN PATENT DOCUMENTS

| | | | |
|---|---|---|---|
| 269668 | 6/1965 | Australia | 222/181 |

*Primary Examiner*—Joseph J. Rolla
*Assistant Examiner*—Michael S. Huppert

[57] ABSTRACT

A washing liquid supplier includes a container filled with washing liquid, a pumping chamber formed in a cylinder under the container and defined by a suction valve formed on the lower opening of the container, a discharge valve formed on the lower portion of the pumping chamber and a nipple button, and a discharge pipe horizontally formed under the discharge valve. The nipple button may be depressed to boost the washing liquid through the discharge pipe into user's hand. The depression of nipple button and pick-up of the liquid can be done at the same time by the single hand of the user for convenient operation.

1 Claim, 3 Drawing Figures

WASHING LIQUID SUPPLIER

BACKGROUND OF THE INVENTION

A conventional container filled with washing liquid or detergent provides an actuating handle atop on the container, which can be depressed to discharge fluid downwards for washing use. It is inconvenient for the user since the actuating handle is operated by user's one hand and the discharged liquid should be picked up by his another hand.

The present inventor has found such an inconvenience defect of conventional container for washing liquid and invented the present washing liquid supplier.

SUMMARY OF THE INVENTION

The object of the present invention is to provide a washing liquid supplier comprising a container for liquid, a valve means and a discharge pipe horizontally fixed under the valve means, wherein the valve means is actuated to pump liquid from the container, through the discharge pipe, for directly flowing into user's hand for convenient use.

DETAILED DESCRIPTION

As shown in the Figures, the present invention comprises: a container 1, a valve means 2 and a discharge pipe 3.

Figure 1:
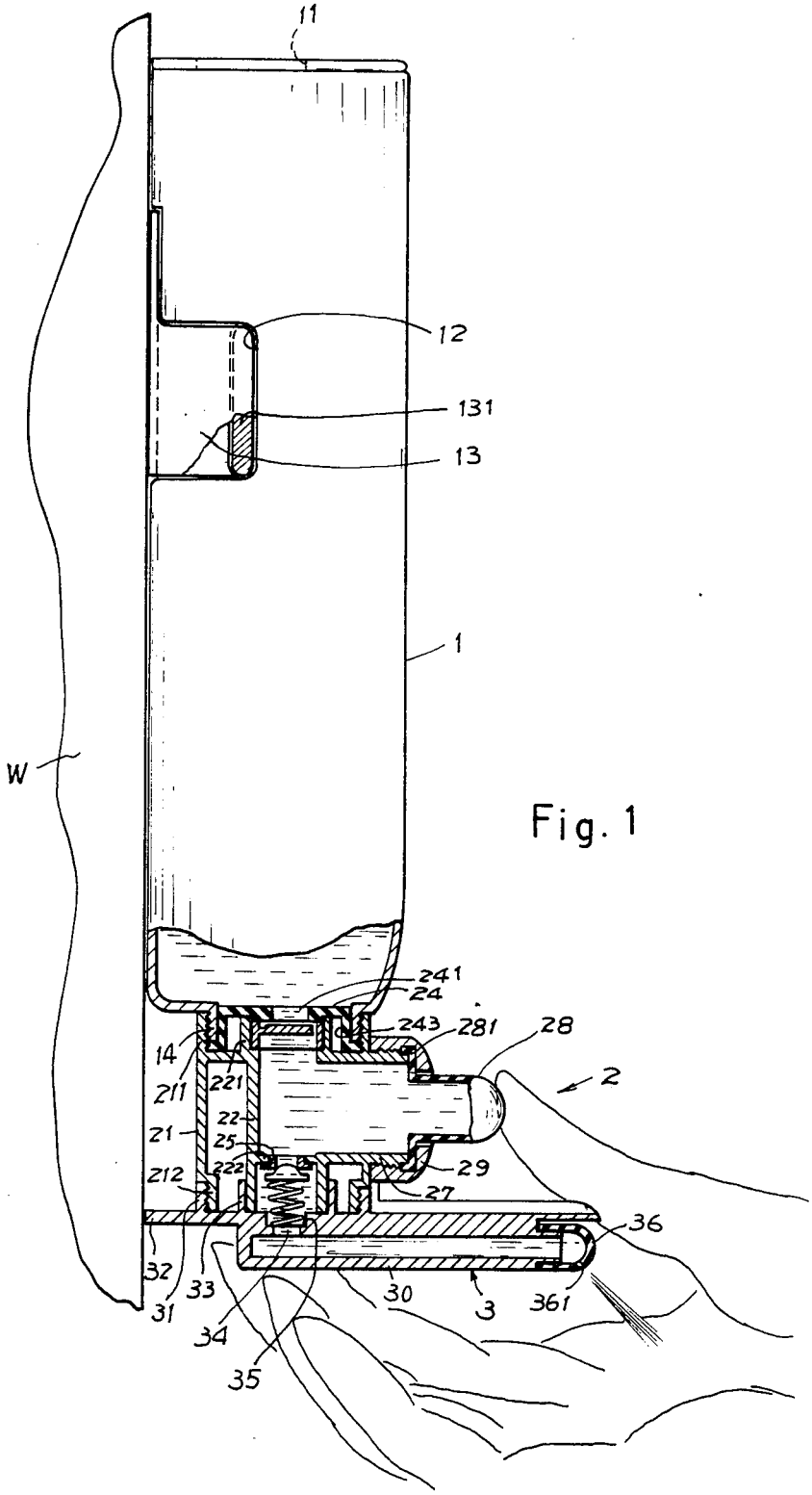
FIG. 1 is an illustration when fixing the present invention on a wall.
Figure 2:
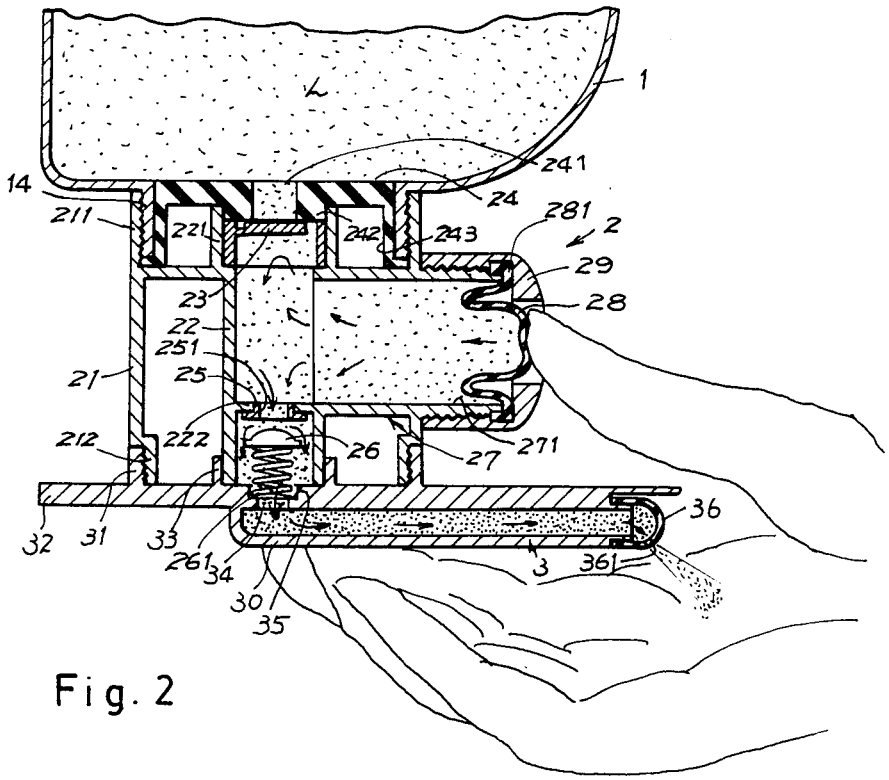
FIG. 2 is a partial sectional drawing showing the depression of present invention for discharging washing liquid.
Figure 3:
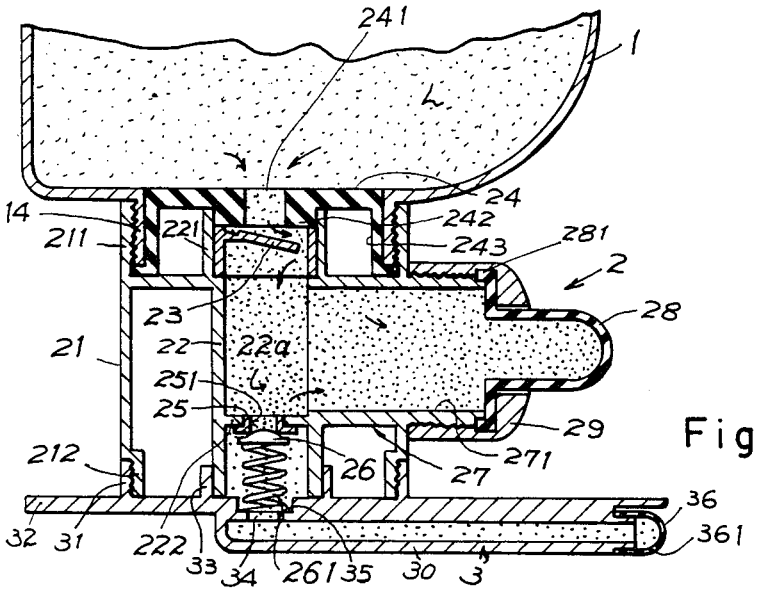
FIG. 3 shows the release of a resilient button of the present invention.

Container 1 is formed with a filling hole 11 atop on the container for refilling washing liquid. Two holding grooves 12 are formed on the container to engage with two engaging hooks 131 formed on a holding bracket 13 which may be adhered or fixed on a wall W as shown in FIG. 1. A male-threaded portion 14 is formed on the lowest portion of container 1 to connect the valve means 2.

Valve means 2 comprises an outer cylinder 21 connecting the container 1 and the discharge pipe 3, an inner cylinder 22 formed within the outer cylinder 2, a suction valve 23 pivotedly and upwards sealing an upper valve seat 24 formed on the opening as defined by the male-threaded portion 14, a discharge valve 26 resiliently and upwards sealing a lower valve seat 25 formed on the lower portion of a pumping chamber 22*a*, a side arm portion 27 transversely connected with pumping chamber 22*a*, a cap 29 terminated on side arm portion 27 and a resilient nipple button 28 extending through a button hole centrally formed on cap 29.

Outer cylinder 21 is formed with an upper female-threaded portion 211 to connect the male-threaded portion 14 of container 1 and formed with a lower male-threaded portion 212 to connect the discharge pipe 3. Inner cylinder 22 is formed with an upper holder 221 for inserting the central extension 242 of valve seat 24 positioned under container 1. Valve seat 24 is lowerly formed with a suction hole 241 to communicate with the pumping chamber 22*a* within the inner cylinder 22. The valve seat 24 is also formed with an outer extension 243 which serves as a packing for female-threaded portion 211 and male-threaded portion 14. The inner cylinder 22 is lowerly formed with a bottom plate having a central hole 222 for fixing valve seat 25. Discharge valve 26 is backed by a restored spring 261 riding on a spring socket 35 on pipe 3. The resilient nipple button 28 is internally formed with an extension 281 which is fixed between side arm portion 27 and cap 29 for packing purposes. Side arm portion 27 is formed with a central hollow portion 271 for pumping action. The pumping chamber 22*a* within inner cylinder 22 is defined among said upper suction valve 23, said lower discharge valve 26 and said nipple button 28.

Discharge pipe 3 is formed as a horizontal pipe 30 under valve means 2 and formed with a female-threaded portion 31 to connect with outer cylinder 21 and formed with a holder 33 to fit the lowest portion of inner cylinder 22. A rear extension 32 is formed on the rear portion of pipe 3 to terminate on a fixed wall W prevent from drop due to eliminate the twisting gravity force or when depressing the button 28. Pipe 3 is formed with a discharge hole 34 to lead liquid from valve means 2 into pipe portion 30. Pipe portion 30 is terminated on its front end with a resilient sealer 36 which may be made with rubber or rubber-like material to resiliently seal the discharge opening 361 formed on the end thereof.

When using the present invention, the button 28 is depressed to pump the washing liquid L to chamber 22*a* by closing valve 23 and opening the valve 26 to discharge fluid through pipe 30 and opening 361 for washing use. When releasing button 28, the pressure in chamber 22*a* is reduced and the valve 23 is opened to suck fluid in container 1 into chamber 22*a* and the valve 26 will as restored by spring 261. The resilient sealer 36, if not under pressure, will automatically seal the opening 361 for hygienic purpose.

I claim:

1. A washing liquid supplier comprising: a container filled with washing liquid and formed with two holding grooves to engage with two hooks of holding bracket fixed on a wall, said container having an opening;

a valve means fixed under said container; and a discharge pipe, horizontally fixed under said valve means and formed with a rear extension to terminate on the fixing wall and terminated on its front end with a resilient sealer to resiliently seal a discharge opening formed on the end of said pipe;

the improvement comprising: said valve means including an outer cylinder upperly connected with said container and lowerly connected with said discharge pipe; and inner cylinder formed within said outer cylinder and in communication with said discharge pipe; an upper valve seat formed in said container opening; a lower valve seat formed in said inner cylinder; a suction valve pivotedly and upwardly sealing against said upper valve seat; a discharge valve resiliently and upwardly sealing against said lower valve seat; said inner cylinder, said suction valve, and said discharge valve difining a pumping chamber;

a side arm portion transversely communicated with said inner cylinder;

a cap having a centrally formed button hole, said cap being attached to said side arm portion;

a resilient nipple button extending through said button hole and mounted between said side arm portion and said cap, whereby said nipple button is depressed to boost washing liquid in said pumping chamber through said discharge pipe into the user's hand for direct and convenient use.

* * * * *